United States Patent [19]

Bieringer et al.

[11] 4,122,758

[45] Oct. 31, 1978

[54] SERVICE SUPPORT

[75] Inventors: Harold F. Bieringer, Peoria; Derrell G. Jones, Washington; Gary S. Schwartzkopf, Aurora, all of Ill.

[73] Assignee: Caterpillar Tractor Co., Peoria, Ill.

[21] Appl. No.: 804,978

[22] Filed: Jun. 9, 1977

[51] Int. Cl.[2] ..... F15B 15/26

[52] U.S. Cl. ..... 92/23; 92/15

[58] Field of Search ..... 92/15, 23; 188/300

[56] References Cited

U.S. PATENT DOCUMENTS

| | | | |
|---|---|---|---|
| 2,397,516 | 4/1946 | Stewart | 188/67 |
| 3,135,555 | 6/1964 | Caskey | 92/23 X |
| 3,662,653 | 5/1972 | Carlson et al. | 92/15 |
| 3,982,648 | 9/1976 | Lvedtke et al. | 92/23 X |

OTHER PUBLICATIONS

"Tool Guide for Caterpillar Dealers", Caterpillar Tractor Co. SFNS-5521-02, pp. 4-7, Jun. 1974.

*Primary Examiner*—Irwin C. Cohen

*Attorney, Agent, or Firm*—Wegner, Stellman, McCord, Wiles & Wood

[57] ABSTRACT

In a lift arm structure for a bucket, for instance on a loader-type vehicle, a service support is provided to block the lift arm in the extended position during servicing and repairing either of the lift arm structure or of parts in close proximity to the lift arm structure. The service support is U-shaped in configuration so as to straddle the rod of the lift cylinder when said lift cylinder is substantially completely extended. Pads are provided on the end of the service support to contact the mounting bracket for better distribution of the loads on the service support. Attachment members are mounted on the service support and engage a plate assembly bridging the open space between the sides of the service support so that with the service support in position on an extended cylinder rod, the attachment members and plate assembly lock the service support on the cylinder rod. The service support has a storage position on the vehicle such that said attachment members and plate assembly serve to lock the service support in said storage position.

15 Claims, 6 Drawing Figures

Fig-2-
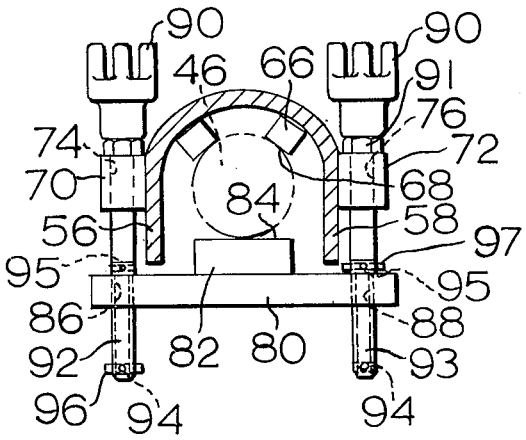
Fig-3-
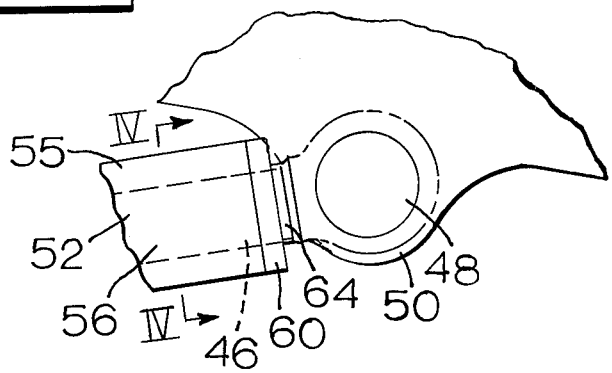
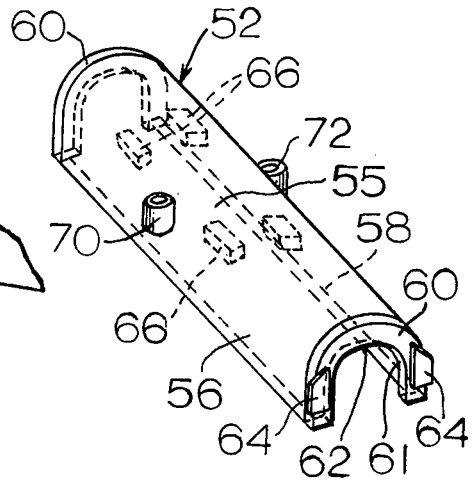
Fig-4-
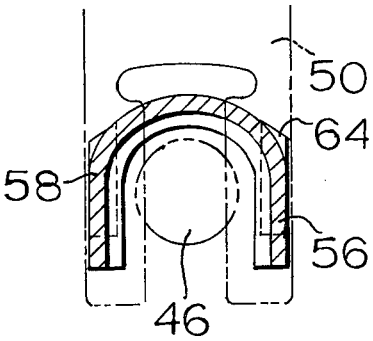
Fig-6-
Fig-5-
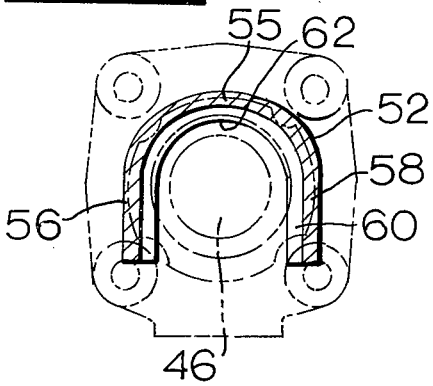

SERVICE SUPPORT

BACKGROUND OF THE INVENTION

1. Field of the Invention

This invention relates to lift arm structures and, more particularly, to a service support for a lift arm structure.

2. Description of the Prior Art

In a vehicle having a lift arm for a bucket, provision must be made for positively blocking the lift arm in the extended position during servicing of the bucket or during servicing of the vehicle in close proximity to the bucket. Heretofore, service supports have been provided for blocking said lift arm in the extended position. One such service support is comprised of a bar secured to the vehicle by two spaced links. A pin between one link and the bar is removed whereupon the bar is pivoted about the connection to the other link into blocking position between one part of the cylinder and the mounting bracket. This system has the disadvantages, first, of having loose parts where the removed pin can be lost and, second, where the bar is not secured to the rod or cylinder, it can pop out of the holding position thereby dropping the bucket.

A second prior system has a service support for a lift arm which support is pivoted to the lift cylinder housing by a link riding in an elongate slot in said service support so that the support is pivoted from a position on top of the cylinder housing to a position on the cylinder rod between the cylinder housing and the mounting eye of the cylinder rod. The chief disadvantages of this system lies in the fact that the service support is not secured to the rod against accidental displacement and the fact that the service support does not extend between the cylinder housing and the mounting bracket.

SUMMARY OF THE INVENTION

The present invention is directed to overcoming one or more of the problems as set forth above.

According to the present invention, a service support is provided which is stored on the vehicle by positive attaching members which attaching members are the same members used to lock the service support positively to the rod between the cylinder housing and the mounting bracket. Pads are provided on the service support for engaging the mounting bracket so as to better distribute the load to the service support. The attaching members are such as to not be separated from the service support so that there are no loose parts that can be lost.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 2 is a cross-sectional view taken along the line 2—2 of FIG. 1;

FIG. 3 is an enlarged broken away view of the connection between the lift cylinder rod and the mounting bracket with our improved service support in position on said rod;

FIG. 4 is a cross-sectional view taken along the line 4—4 of FIG. 3;

FIG. 5 is a cross-sectional view taken along the line 5—5 of FIG. 1; and

FIG. 6 is a perspective view of the service support of our invention removed from a vehicle.

DESCRIPTION OF THE PREFERRED EMBODIMENT

Figure 1:
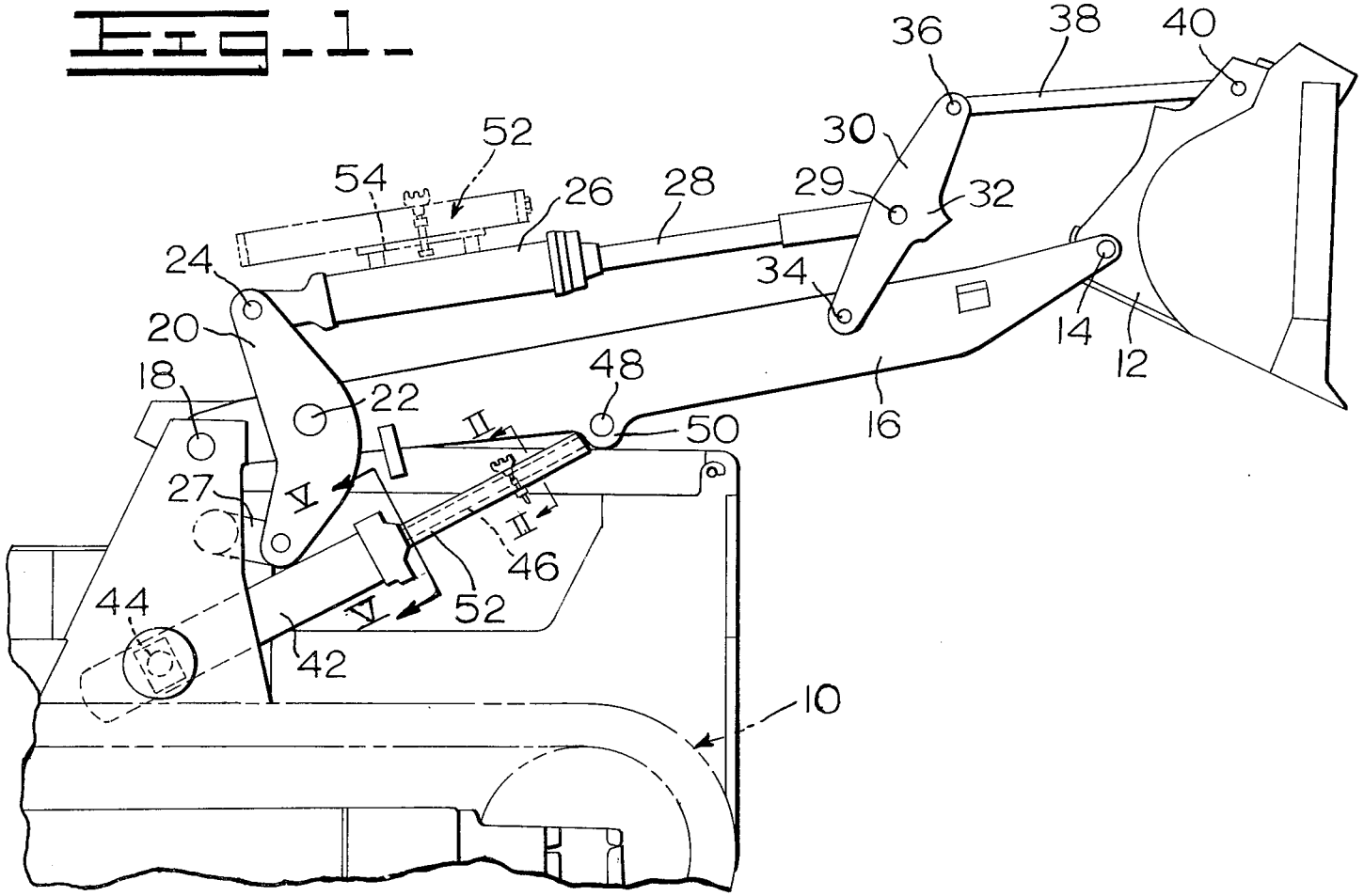
FIG. 1 is an elevational view of a vehicle having a bucket with a service support in position to hold the bucket in the raised position.

Referring to the drawings wherein like reference numerals refer to like parts throughout and, in particular, to FIG. 1, a tractor-type vehicle 10 is illustrated and has a bucket 12 operatively connected to the vehicle with a mechanism that permits raising and lowering of said bucket 12 and tilting said bucket 12 for loading and dumping material into and from said bucket 12.

The bucket 12 is pivotally connected at pivot 14 to a boom or arm 16 which boom or arm 16 is pivotally connected to pin 18 to the vehicle 10. A bell crank 20 is pivotally mounted at 22 to the boom 16 and has the end portion of one arm pivotally mounted at 24 to a tilt cylinder 26. The end portion of the other arm of the crank 20 is pivotally connected through a link 27 to the vehicle 10. An extendible rod 28 of the cylinder 26 is pivotally connected at pivot 29 to the link 30 at a mid-portion 32 thereof. The link 30 is pivotally mounted at one end by a pivot 34 to the boom 16 and has its other end pivotally mounted at pivot 36 to the link 38 which, in turn, is pivotally connected at pivot 40 to an upper portion of the bucket 12. A lift cylinder 42 is pivotally mounted at pivot 44 to the vehicle 10. The lift cylinder 42 has an extendible cylinder rod 46 which is connected by pivot 48 to a mounting bracket 50 protruding downwardly from the boom 16.

In normal use of the vehicle, the lift cylinder 42 is activated to raise and lower the boom 16 and bucket 12. The tilt cylinder 26 is used to pivot the bucket 12 about the pivot 14 for loading and unloading the bucket. All of the just described structure is well known in the art.

A service support 52 is provided for the lift cylinder 42 and, as shown in FIG. 1, is shown in phantom in the stored position when it is bolted to a bracket 54 carried by the tilt cylinder 26. The service support 52 is shown in solid lines in the position of use when it is clamped onto the cylinder rod 46 of the cylinder 42.

The details of the service support 52 are shown more clearly in FIGS. 2 through 6 and, in particular, referring to FIG. 6, a perspective view of the service support 52 is shown wherein the support has a body portion 55 which is U-shaped in cross section, being open on the bottom between the downwardly disposed legs 56,58. U-shaped end caps 60 are secured to each end of the body portion 55 of the support 52 which end caps 60 extend radially, inwardly in overhanging relationship with respect to the thickness of the body portion 55. The U-shaped edge 61 of each end cap 60 is slightly larger than the outer diameter of the rod 46 so that when the support 52 is placed over the rod 46, the rod 46 will fit up into the end caps 60 with the arc 62 of the edge 61 substantially conforming to the shape of the rod 46. On the front or right-hand portion of the support 52, a pair of axially projecting pads 64 may be rigidly secured to the end cap 60. The pads 64 are spaced apart so that in the vicinity of the curved portion or arc 62 of the cap 60, there is no axially extending pad. The pads 64 somewhat conform to the shape of the legs of the U-shaped cap 60 but, as can be seen in FIG. 4, the outer edges of the pads 64 extend upwardly beyond the curved line of the U-shaped cap 60 so as to provide additional bearing surface for the pads 64. In some applications, the pads 64 are not needed or are not used.

On the inside of the body portion 55 of the support 52 is formed a plurality of radially, inwardly extending abutments or bumpers 66, which abutments or bumpers have contact surfaces 68, which surfaces lie in a line extending from one arc 62 of the edge 61 of one cap 60 to the comparable edge 61 of the other cap 60. A pair of mounting lugs or ears 70,72 are welded or otherwise permanently secured to the legs 56,58 of the U-shaped body 55 of the support 52. The lugs or ears 70,72 are aligned with each other and have openings 74,76, respectively, therethrough with the centerlines of said openings 74,76 lying parallel to each other and extending perpendicular to a plane containing the bottom edges of the legs 56,58 of the U-shaped body portion 55.

As best shown in FIG. 2, a plate assembly 80 bridges the space between the legs 56 and 58 of the U-shaped body 55 and has a supporting block 82 secured on the upper surface thereof with a contact surface 84 of the block 82 projecting toward the inside of the support 52. The plate assembly 80 has a pair of threaded apertures 86,88 through the outer end portions thereof. The apertures 86,88 are adapted to be aligned with the openings 74,76 in the lugs or ears 70,72. Headed nuts, or the like, 90 are provided on one end of a pair of elongate threaded bolts 92,93 with lock nuts 91 threaded up against the headed nuts 90 such that the bolts 92,93 are inserted through the openings 74,76 in the lugs or ears 70,72 and are threaded into the threaded apertures 86,88 in the plate assembly 80. With the support 52 positioned over the extended rod 46, the bolts 92,93 are threaded into the plate 80 until the block 82 firmly engages the rod 46 and urges the contact surface 68 on the abutments 66, likewise, into contact with said rod 46. It should be noted that each threaded bolt 92,93 has a pair of axially spaced apart, transverse openings 94,95 with one opening 94 being close to the projecting end of the bolts 92,93 and the other opening 95 being spaced therefrom above the plane of the plate 80. A pin 96 seats in opening 94 close to the end of one bolt 92 and a second pin 97 seats in opening 95 in the other bolt 93. The bolt 92 threaded through the plate assembly 80 has the pin 96 below the plate assembly 80 such that the plate assembly 80 cannot be separated from that particular bolt 92. The upper pin 97 on the bolt 93 prevents the bolt from being pulled up through the lug or ear 72, when the lower part of said bolt 93 is unthreaded from the plate 80. Therefore, it can be seen that the headed nuts 90, bolts 92,93 and the plate assembly 80 are all attached together and are attached to the body 55 of the support 52 in such a way that accidental separation of the plate 80, body 55 and bolts 92,93 is not possible.

During normal use of the vehicle, the service support 52 is secured to the bracket 54 by means of the plate assembly 80 passing below the crosspiece of the bracket 54 and being secured thereto by the tightening of the two headed nuts 90 on the support 52. When it is desired to block the lift cylinder 42 in the extended position, the headed nuts 90 ad bolts 92,93 are turned to loosen the plate assembly 80 from the crosspiece of the bracket 54. Bolt 93 is threaded completely out of the plate assembly 80, whereupon the plate assembly is pivoted and the service support 52 is removed from the mounting bracket 54. With the lift cylinder 42 activated to elongate the cylinder rod 46, the service support 52 is assembled over the rod 46 with the cap 60 on the one end bearing against the cylinder housing and with the pads 64 on the other cap 60 of the support 52 bearing against the edge of the mounting bracket 50. The plate assembly 80 is pivoted beneath the rod 46 and the loosened headed nut 90 and bolt 93 are threaded into the aperture 88 in the plate assembly 80, both headed nuts 90 and bolts 92,93 are now tightened to move the block 82 and abutments 66 into engagement with the rod 46. The pressure on the rod 46 in the cylinder 42 can be cut off whereupon the service support 52 will support the bucket 12 by bearing between the housing of the cylinder 42 and against the mounting bracket 50 on the boom 16.

Due to the positive locking arrangement of the service support 52 on the rod 46, it is not possible for the service support 52 to pop out or drop out of supporting position. The U-shape of the support 52 and the method of attaching the plate 80 to the two legs 56,58 of the support 52, prevent the legs from spreading thereby adding stability and rigidity to the support. The spacing of pads 64 on the cap 60 permits the shape of the mounting bracket 50 to conform to the pads 64 to apply more direct axial force to the support 52. In some applications, the pads 64 are not needed because the mating contact surface of the bracket 50 is such that adequate direct contact with the end cap 60 is obtained without the pads 64.

The embodiment of the invention in which an exclusive property or privilege is claimed is defined as follows:

1. A service support in combination with a cylinder rod of a cylinder, said service support comprising an elongate U-shaped body portion having legs with bottom edges adapted to be placed over said cylinder rod, a pair of lugs carried by an intermediate portion of said body portion and extending outwardly an opposite sides thereof along axes extending perpendicular to a plane containing the bottom edges of said legs, a plate bridging the space between the legs of said U-shaped body portion and having threaded apertures aligned with said lugs, and a pair of threaded members passing through said lugs and being threaded into said apertures in said plate to secure said body portion to said cylinder rod.

2. In a service support as claimed in claim 1 wherein end caps are provided on the ends of said body portion, said end caps having U-shaped openings for receiving said cylinder rod of the cylinder therein.

3. In a service support as claimed in claim 2 wherein axially extending pads are mounted on one of said end caps, said pads are spaced apart and extend axially outward from said end cap.

4. In a service support as claimed in claim 1 wherein one of said threaded members has stop means for preventing said threaded member from separating from said plate and the other of said threaded members has limit means for preventing said other threaded member from separating from one of said lugs on said body portion.

5. In a service support as claimed in claim 1 wherein said plate has a supporting block means projecting into the space between said legs of the body portion.

6. In a service support as claimed in claim 1 wherein said body portion has abutment means on the inner surface thereof projecting toward the open space between said legs of the body portion and being adapted to contact said cylinder rod when said body portion is placed over said cylinder rod.

7. In a service support as claimed in claim 1 wherein said threaded members include headed nuts to facilitate turning said threaded members.

8. A service support in combination with a cylinder rod of a cylinder, said service support comprising an elongate U-shaped body portion having legs, a pair of end caps mounted on the ends of said body portion, a pair of pads mounted on one of said end caps and projecting axially thereof, said pads being adapted to contact a mounting bracket supporting one end of the cylinder rod when said body portion encircles said cylinder rod, a pair of lugs mounted on said body portion and extending outwardly on opposite sides thereof, a plate bridging the space between the legs of said U-shaped body portion and having threaded apertures aligned with said lugs, and a pair of threaded members passing through said lugs and being threaded into said apertures in said plate to hold said body portion assembled with said cylinder rod.

9. In a service support as claimed in claim 8 wherein said end caps extend radially inwardly from the inner surface of said body portion to provide contact edges for said support on said cylinder rod.

10. In a service support as claimed in claim 8 wherein a supporting block is mounted on said plate and projects into the space in said body portion and being adapted to contact said cylinder rod.

11. In a service support as claimed in claim 8 wherein means are provided on said threaded members for trapping said plate to one of said threaded members and for trapping the other of said threaded members to said body portion.

12. A service support in combination with a cylinder rod of a cylinder, said service support comprising an elongate U-shaped body portion having legs adapted to be draped over said cylinder rod, a pair of pads on a forward end of said body portion and projecting axially thereof, said pads being adapted to contact a mounting bracket supporting one end of said cylinder rod, a pair of lugs carried by the opposite sides of said body portion and extending outwardly on opposite sides thereof, a plate bridging the space between the legs of said U-shaped body portion and having threaded apertures aligned with said lugs, a pair of bolts passing through said lugs and being threaded into said apertures in said plate with said plate positioned below said cylinder rod of the cylinder, and a block mounted on said plate and adapted to contact said cylinder rod of said cylinder.

13. In a service support as claimed in claim 12 wherein said pads are mounted on an end cap secured to one end of said body portion.

14. In a service support as claimed in claim 13 wherein a plurality of abutment members are mounted in said body portion with the abutment members having abutment surfaces in contact with said cylinder rod.

15. In a service support as claimed in claim 14 wherein means are provided for trapping said plate to one of said threaded members and means are provided for trapping the other of said threaded members to one of said lugs on said body portion.

* * * * *